US005658113A

United States Patent [19]

Lazo

[11] Patent Number: 5,658,113

[45] Date of Patent: Aug. 19, 1997

[54] BUILDING PANEL HANDLING DEVICE AND METHOD OF USE THEREFOR

[76] Inventor: David Lazo, 2628 Simon Pl., Apt. #2A6, West Haven, Conn. 06516

[21] Appl. No.: 690,323

[22] Filed: Jul. 25, 1996

[51] Int. Cl.[6] ..... E04G 21/14

[52] U.S. Cl. ..... 414/11; 414/78; 52/716.8; 269/904

[58] Field of Search ..... 414/10, 11, 786; 269/902, 904, 905; 248/146, 152, 473; 52/716.4, 716.8, DIG. 1

[56] References Cited

U.S. PATENT DOCUMENTS

| | | | |
|---|---|---|---|
| 1,725,329 | 8/1929 | Blandford . | |
| 4,026,088 | 5/1977 | Akabane | 52/716.8 |
| 4,164,346 | 8/1979 | Sickler | 269/904 |
| 4,254,945 | 3/1981 | Paulson et al. | 269/904 |
| 4,375,934 | 3/1983 | Elliott . | |
| 4,600,348 | 7/1986 | Pettit . | |
| 4,826,390 | 5/1989 | Paxton | 414/11 |
| 4,836,517 | 6/1989 | Vossler | 269/904 |
| 4,862,669 | 9/1989 | Jacobsen | 52/DIG. 1 |
| 5,129,774 | 7/1992 | Balseiro et al. . | |
| 5,192,059 | 3/1993 | Silver | 269/904 |
| 5,290,019 | 3/1994 | Beyers | 269/904 |
| 5,303,899 | 4/1994 | Palya . | |
| 5,320,470 | 6/1994 | Russell . | |

*Primary Examiner*—David A. Bucci
*Assistant Examiner*—Douglas Hess
*Attorney, Agent, or Firm*—Cummings & Lockwood

[57] ABSTRACT

A device and a method are disclosed for handling construction materials such as wall boards or the like. The device includes an elongated body and an upstanding wall which projects from the top surface of the body between the opposed front and rear surfaces thereof. The upstanding wall and the top surface of the body cooperate to form a support region therebetween for supporting a building panel proximate a supporting structure such as a stud wall. In use, the device is temporarily secured to the supporting structure and a building panel such as a wall board is positioned in the support region. Once positioned in the support region, the wall board may be easily manipulated and secured to the supporting structure by a sole individual.

18 Claims, 4 Drawing Sheets

50
10
24
30c
40
34b
40
40
30b
12
34a
30a 30c
25
26
30b
24
14
24a
28e
24b
32b
34b
30a
28d
23
20
23
18
28c
10
16
28b
22
32a
34a
28a

Fig. 3
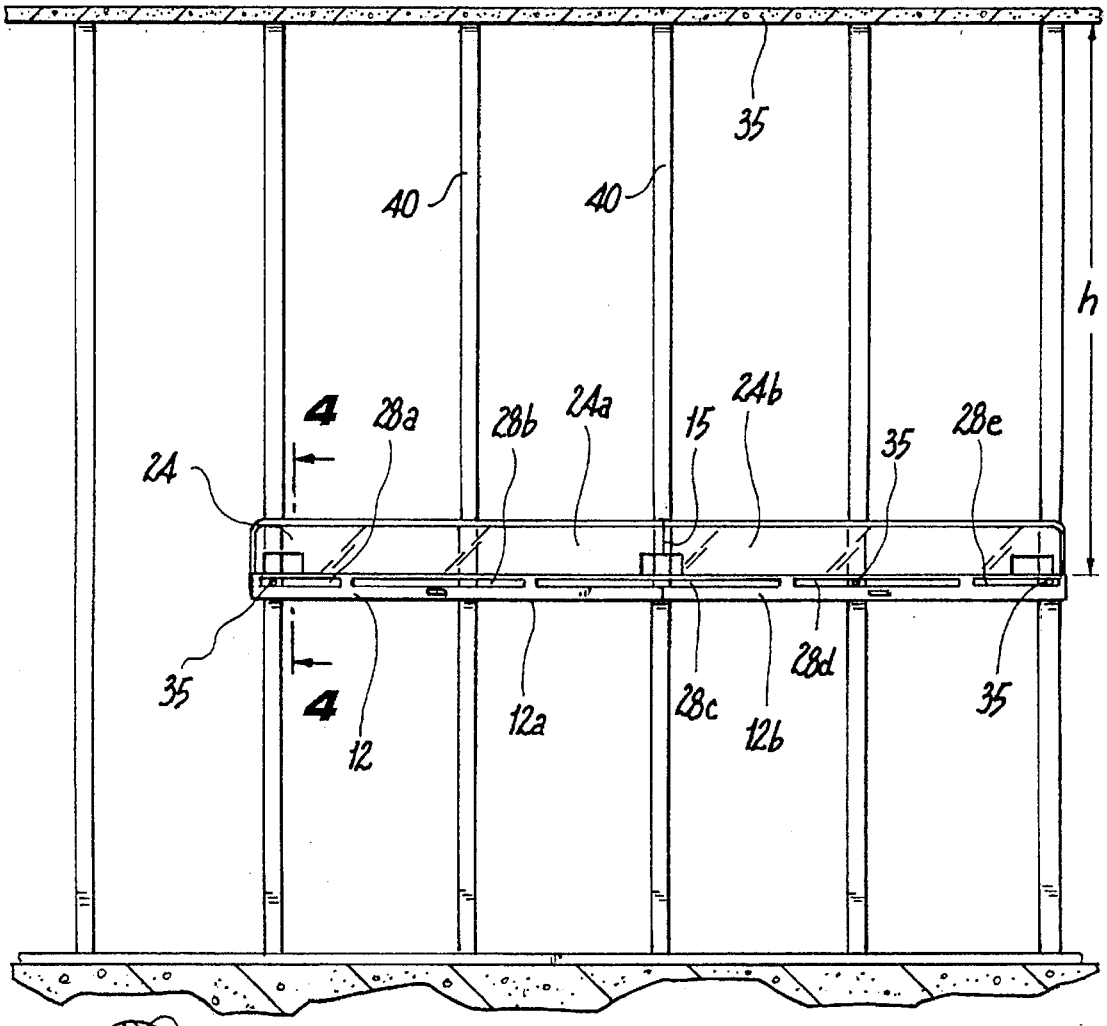
Fig. 4
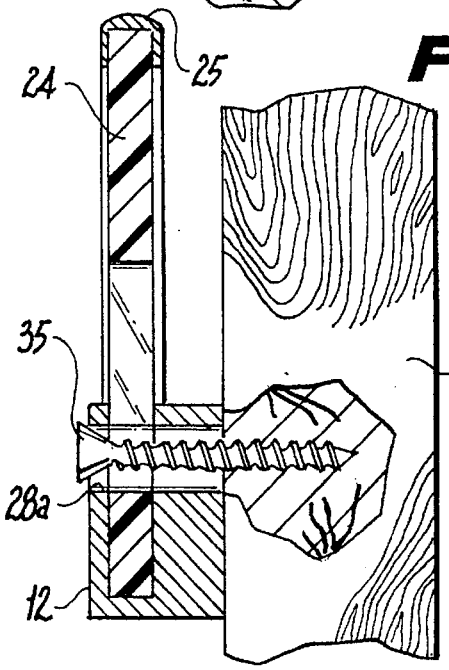
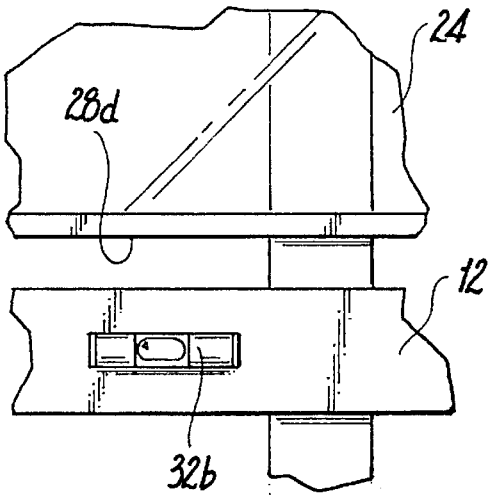
Fig. 5

BUILDING PANEL HANDLING DEVICE AND METHOD OF USE THEREFOR

BACKGROUND OF THE INVENTION

1. Field of the Invention

The subject invention is related to a handling device for construction materials, and more particularly, to a device and method for handling building panels such as wall boards, ceiling panels and the like.

2. Background of the Related Art

In the construction of homes and other buildings, the interior walls and ceilings are commonly fabricated from large sheets of material which are secured to the upright studs forming the walls or horizontal joists forming the ceilings of the building. Often, these sheets of material are as large as 4 feet by 8 feet and are considerably heavy. Thus, it is particularly difficult for one person to precisely orient and properly secure a sheet of building material to a wall or ceiling, without the assistance of another person. As a result, the labor costs associated with construction can be rather high.

In the past, there have been several mechanical devices which were designed to enable a sole individual to manipulate and position large sheets of building material when constructing a building. Some of these devices were free standing structures. For example, U.S. Pat. No 1,725,329 to Blandford discloses a device including a pivoting panel holding platform mounted on a height-adjustable telescoping post. Similarly, U.S. Pat. No. 4,600,348 discloses a panel hoist having a telescoping mast assembly and a collapsible framework for supporting a building panel.

Other prior art devices were designed to be secured to the wall or ceiling to which the building panel was to be secured. For example, U.S. Pat. No. 4,826,290 to Paxton discloses an apparatus which includes a pair of spaced apart sheet material supporting pivot arms connected to one another by a rod and configured to be attached to spaced apart joists or studs. Similarly, U.S. Pat. No. 5,320,470 discloses a device which includes a plurality of angled cross-bars designed to be fastened to a building frame to support a building panel. Although both of these prior art devices are adequately designed to support a building panel adjacent a wall or ceiling, they provide no means for effectuating the precise positioning of the panel or for facilitating fine adjustment of the panel once it is in position.

As labor costs associated with building construction continue to increase at an alarming rate, is has become apparent that an improved panel handling device configured to support a building panel adjacent a wall or ceiling and enable a sole individual to precisely position and manipulate the panel would be desirable.

SUMMARY OF THE INVENTION

The subject invention is directed to a device for handling construction materials, and more particularly, to a device which advantageously enables an individual to support, precisely manipulate and secure a building panel, such as a wall board, to a supporting structure, such as a stud wall, without the assistance of another person. The device includes an elongated body defining opposed front and rear surfaces and opposed top and bottom surfaces, and an upstanding wall which projects from the top surface of the body between the opposed front and rear surfaces thereof.

The upstanding wall and the top surface of the body form a support region therebetween for supporting a building panel adjacent a supporting structure. A plurality of spaced apart apertures extend through the body of the device from the front surface thereof to the rear surface thereof to accommodate a plurality of fasteners used to temporarily mount the body to the supporting structure. Preferably, the spacing between the spaced apart apertures corresponds to the spacing between a plurality of spaced apart structural members forming the supporting structure. For example, where the supporting structure is a conventional stud wall the apertures formed in the body of the device are spaced at approximately 16.0 inch centers.

Preferably, the elongated body is generally rectangular in configuration and the upstanding wall which is coextensive therewith is substantially perpendicular to the top surface of the body. The distance between the upstanding wall and the rear surface of the body is preferably greater than the distance between the upstanding wall and the front surface of the body. The upstanding wall is preferably fabricated from a transparent material and a frame extends about a peripheral edge thereof to protect the upstanding wall. In a preferred embodiment of the subject invention, at least one access port extends through the upstanding wall adjacent the top surface of the body to facilitate manipulation of a building panel positioned in the support region. Moreover, the access port or ports are dimensioned and configured to accommodate a manipulating implement such as, for example, an elongated pry bar.

In accordance with a preferred embodiment of the subject invention, at least one leveling instrument is operatively associated with the body of the handling device for observing the position of the body relative to the supporting structure. Preferably, at least two leveling instruments are recessed into the front surface of the body and are disposed in spaced apart relationship. The leveling instruments are preferably conventional liquid filled bubble-type leveling vials. However, other types of leveling device known in the art may be employed.

The subject invention is also directed to a method of attaching a building panel adjacent a supporting structure comprising the steps of positioning an elongated panel handling device having a panel support region defined thereon adjacent a supporting structure, temporarily securing the device to the supporting structure, positioning an elongated building panel within the panel support region of the device, fastening the building panel to the supporting structure, and subsequently removing said elongated panel handling device from said supporting structure.

Preferably, the step of positioning the panel handling device adjacent the supporting structure includes the step of leveling the orientation of the panel handling device relative to the supporting structure, and the step of temporarily securing the panel handling device to the supporting structure includes the step of extending a plurality of fasteners through a plurality of spaced apart apertures defined in the device and temporarily securing the fasteners to the supporting structure. The method further comprises the step of manipulating the building panel disposed within the panel support region to adjust the position thereof with respect to the supporting structure. Preferably, the step of manipulating the building panel includes the step of extending a manipulating implement through a selected access port defined in the panel handling device.

Further features of the unique building panel handling device of the subject invention and the method of use therefor will become more readily apparent to those having ordinary skill in the art from the following detailed description taken in conjunction with the drawings.

BRIEF DESCRIPTION OF THE DRAWINGS

So that those having ordinary skill in the art to which the subject invention appertains will more readily understand how to construct and use the panel handling device described herein, preferred embodiments of the device will be described in detail hereinbelow with reference to the drawings wherein:

FIG. 3 is an elevational view of a stud Wall with the building panel handling device of the subject invention temporarily secured thereto;

FIG. 4 is a cross-sectional view taken along line 4—4 of FIG. 3 illustrating a threaded fasteners used to temporarily secure the building panel handling device of the subject invention to the stud wall;

FIG. 5 is an enlarged localized elevational view of the building panel handling device of the subject invention illustrating the leveling instrument associated therewith;

DETAILED DESCRIPTION OF THE PREFERRED EMBODIMENTS

Figure 1:
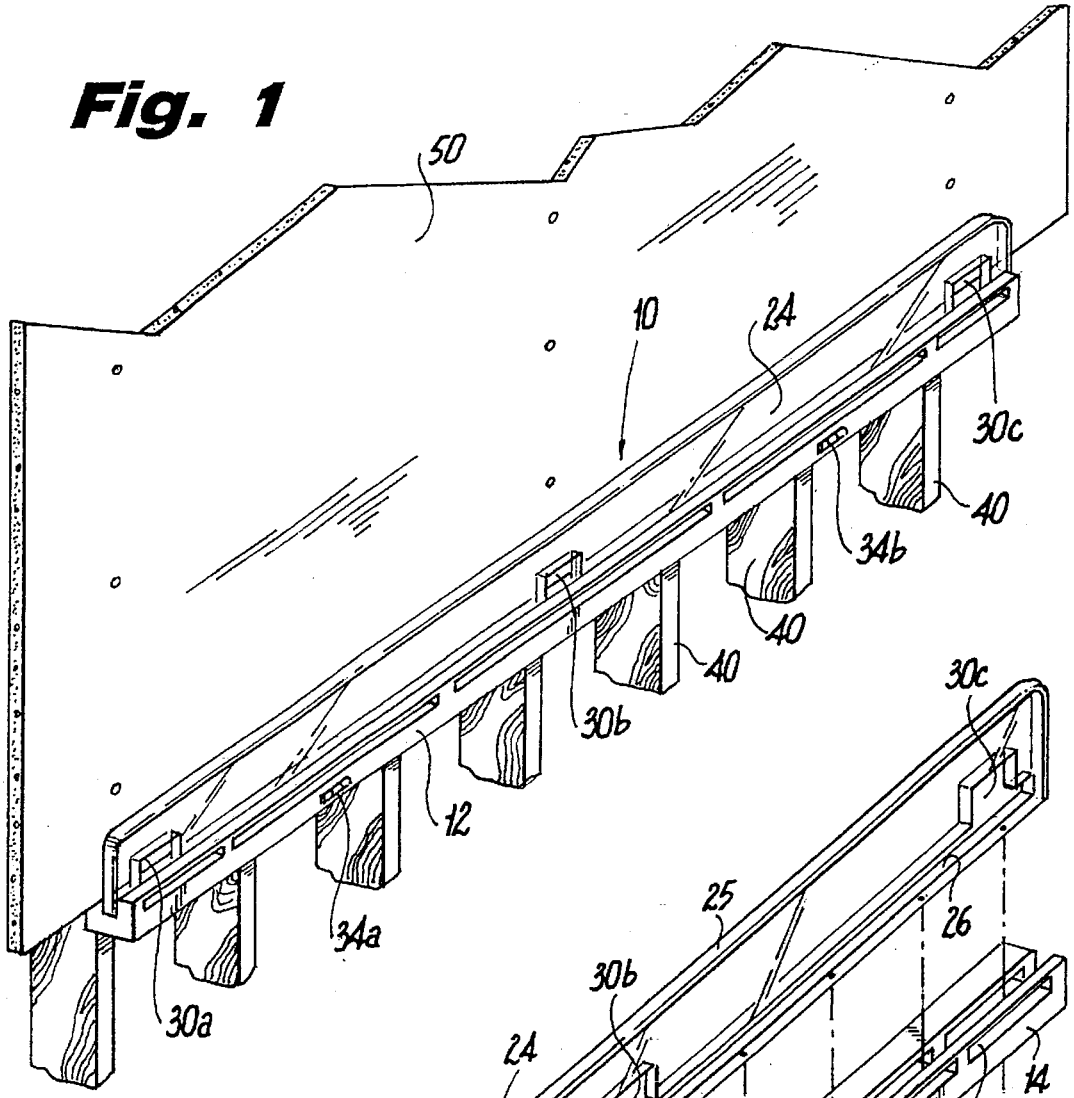
FIG. 1 is a perspective view of a building panel handling device constructed in accordance with a preferred embodiment of the subject invention temporality secured to a stud wall and supporting a building panel

Referring now to the drawings wherein like reference numerals identify similar structural elements, the building panel handling device of the subject invention is illustrated in FIG. 1 and is designated generally by reference numeral 10. As illustrated in FIG. 1, building panel handling device 10 is uniquely adapted and configured to be secured to a supporting structure, such as, for example, a plurality of spaced apart studs or ceiling beams, to support a building panel, such as, for example, a gypsum wall board or plywood ceiling panel, adjacent the supporting structure, in such a manner so that a sole individual can manipulate, adjust and fixedly secure the building panel to the supporting structure without the assistance of another individual.

Figure 2:
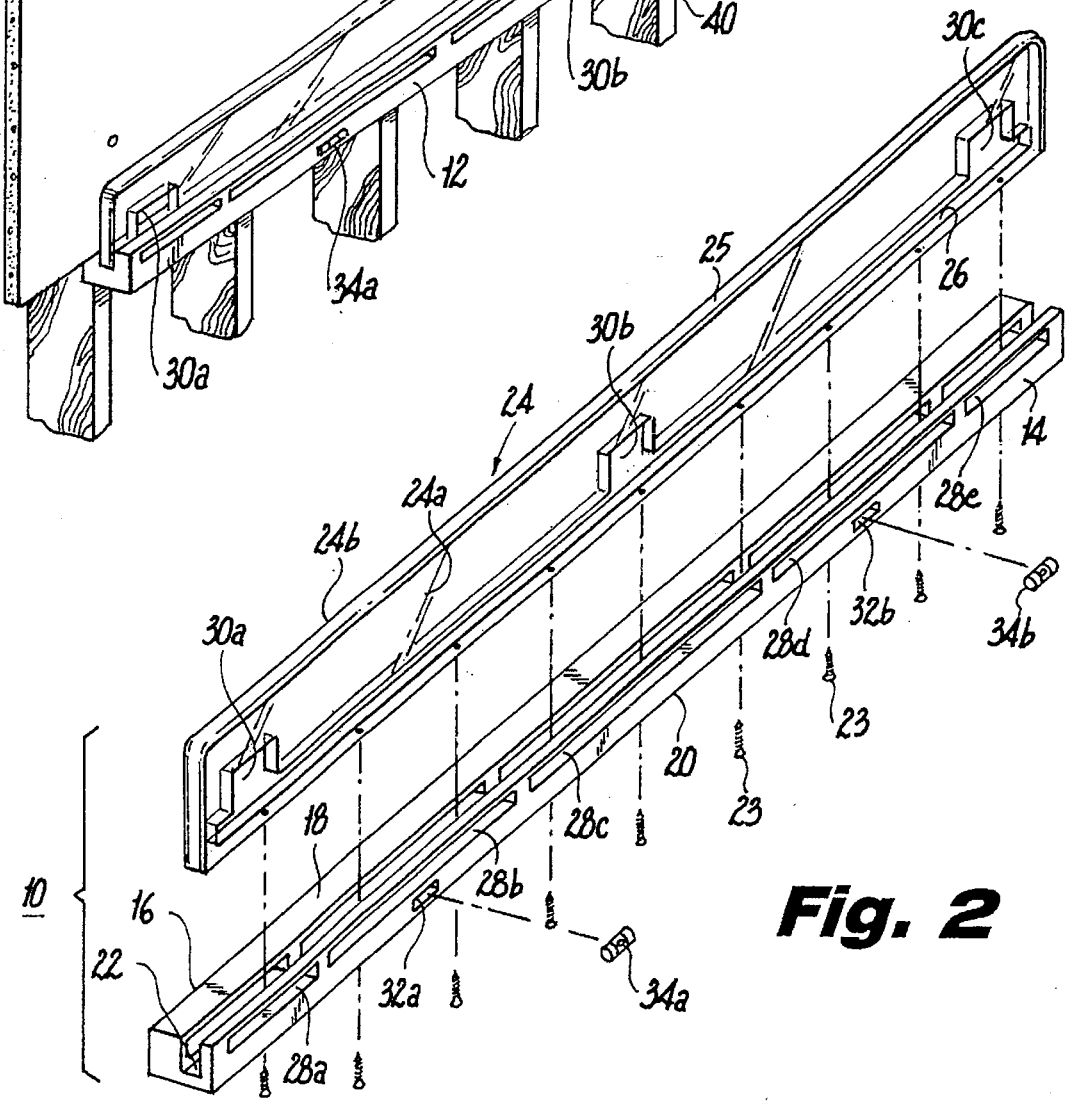
FIG. 2 is an exploded perspective view Of the building panel handling device of the subject invention with parts separated for ease of illustration.
Figure 6:
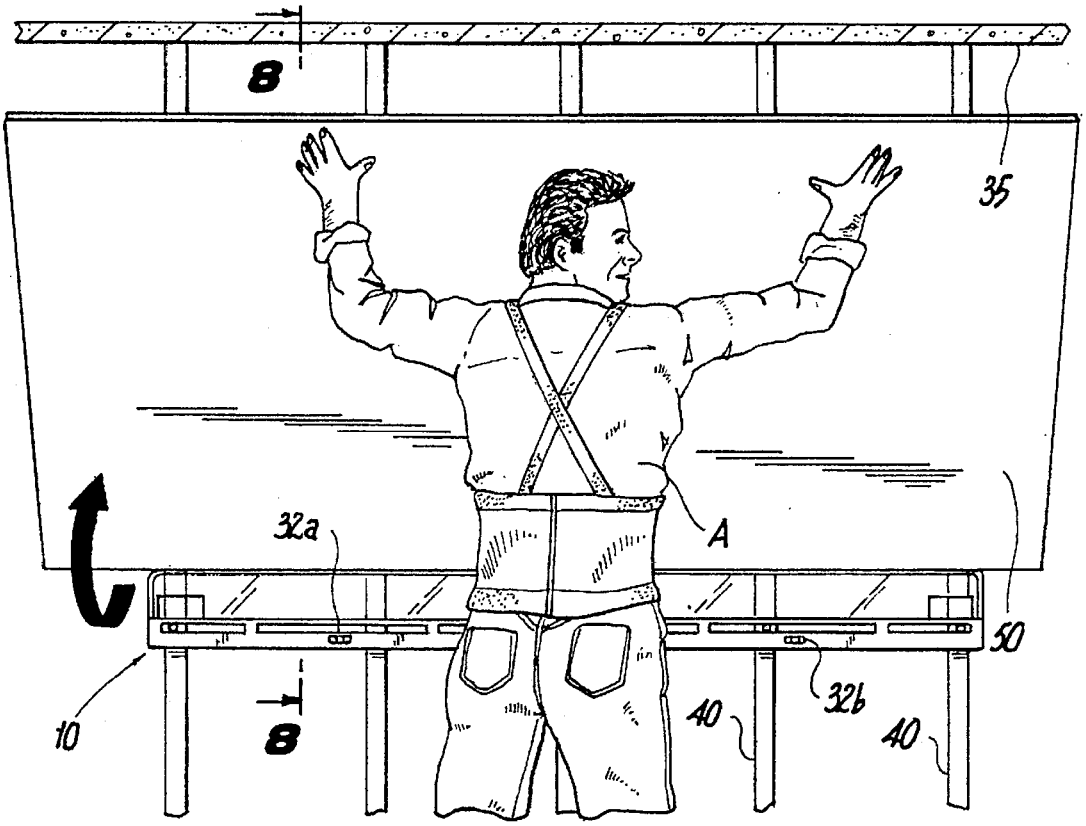
FIG. 6 illustrates a carpenter installing positioning a building panel adjacent a stud wall utilizing the building panel handling device of the subject invention.
Figure 7:
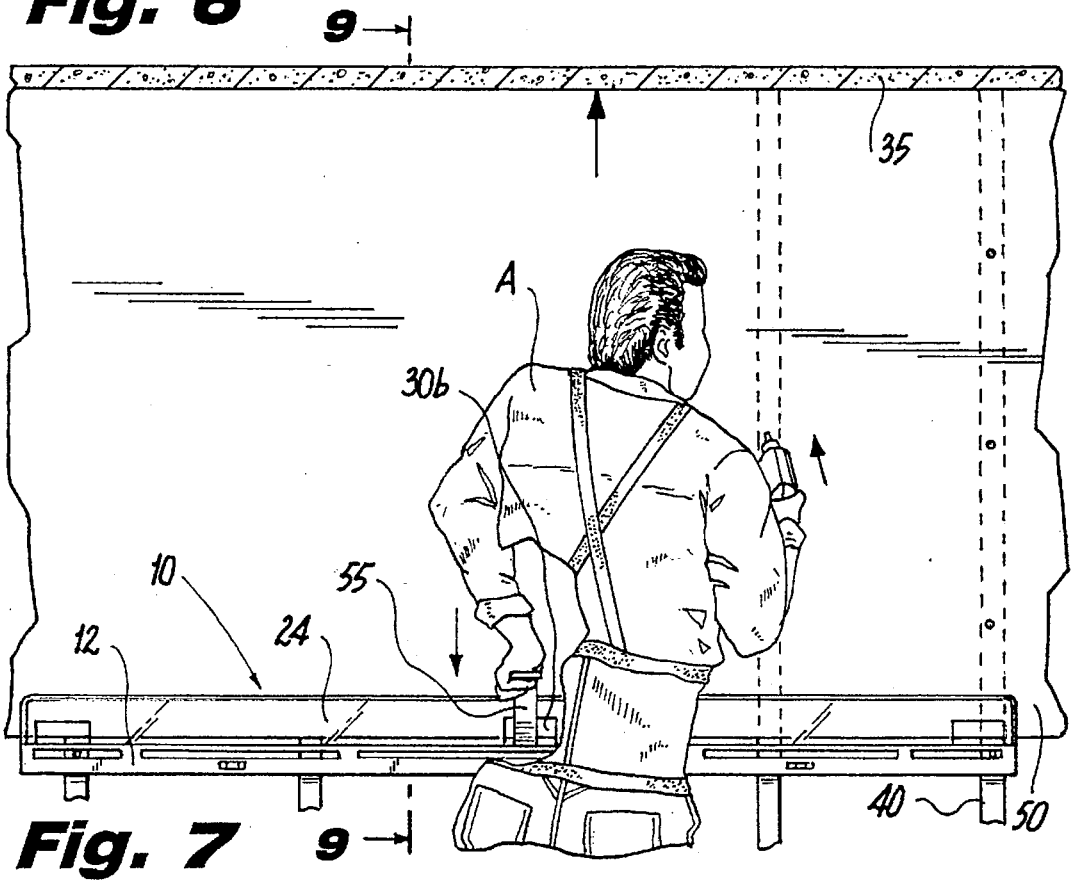
FIG. 7 illustrates a carpenter manipulating the building panel supported by the handling device utilizing a pry bar and securing the building panel to the stud wall utilizing a power tool.
Figure 8:
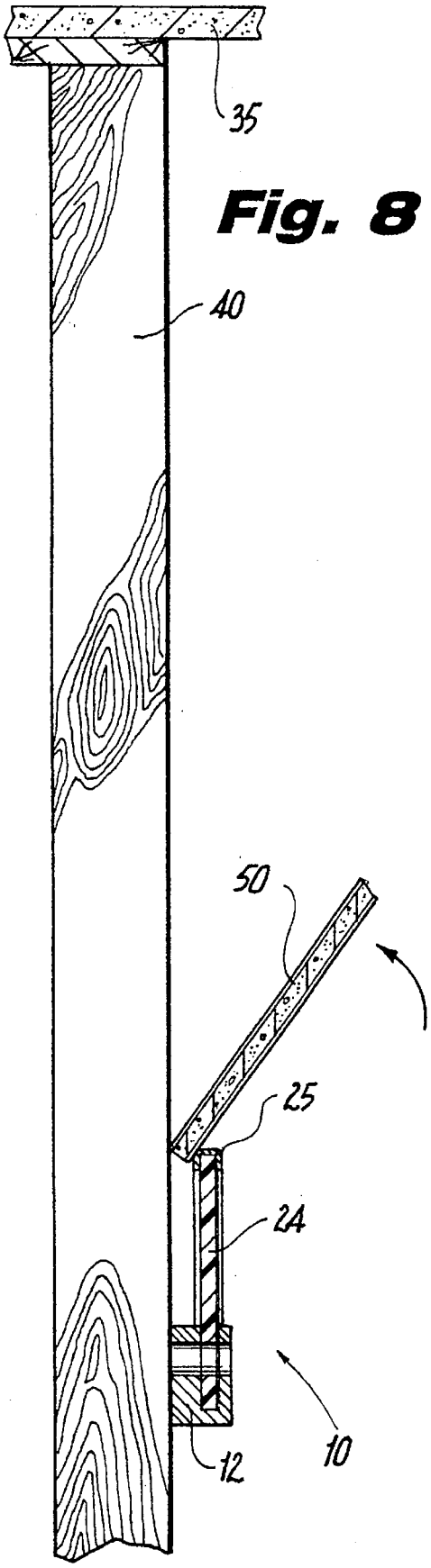
FIG. 8 is a cross-sectional view taken along line 8—8 of FIG. 6.

Referring now to FIG. 2, the building panel handling device 10 of the subject invention includes an elongated body 12 defining opposed front and rear surfaces 14 and 16 and opposed top and bottom surfaces 18 and 20. The elongated body 12 is preferably constructed of a durable lightweight material, such as, for example, wood or aluminum. In a preferred embodiment of the subject invention, the overall length of body 12 is about 6.0 feet, the width of the body is about 1.50 inches, and the height is about 2.0 inches. One of ordinary skill in the art will appreciate however, that these dimensions may be varied or modified and they should not be viewed as limiting the invention disclosed herein.

An elongated channel 22 extends along the entire length of body 12, adjacent the front surface 14 thereof, for receiving and retaining an upstanding wall 24. Conventional threaded fasteners 23 are preferably utilized to secure the upstanding wall 24 within the elongated channel 22. The upstanding wall 24 and the top surface 18 of the elongated body 12 cooperate to form a generally "L-shaped" support region for supporting a building panel adjacent a supporting structure, i.e., a stud wall or ceiling joists. Preferably, the upstanding wall 24 is constructed from a lightweight plastic material, such as, for example, plexiglass, although other materials of construction may be employed. A relatively thin metallic bezel 25 surrounds the periphery of upstanding wall 24 to protect its structural integrity. In a preferred embodiment of the subject invention, the upstanding wall 24 is about 0.50 inches in width and about 4.0 inches in height so that the overall height of panel handling device 10 is approximately 6.0 inches. Upstanding wall 24 is preferably positioned so that the front surface 24*a* thereof is 0.25 inches from the front surface 14 of elongated body 12 and the rear surface 24*b* is 0.75 inches from the rear surface 16 of elongated body 12. Once again, those skilled in the art will readily appreciate that the dimensions set forth herein can be varied without departing from the spirit or scope of the subject invention.

Referring to FIG. 2 in conjunction with FIG. 4, at least one elongated slot 26 and a plurality of correspondingly positioned spaced apart elongated slots 28*a*–28*e* of varying length extend through the upstanding wall 24 and the elongated body 12, respectively, to accommodate a plurality of threaded fasteners 35 used to temporarily secure the building panel handling device 10 to a supporting structure such as stud wall 40, as shown for example in FIG. 3. Slots 28*a*–28*e* are preferably spaced apart a sufficient distance to correspond to the spacing of the studs 40 forming stud wall, i.e. 16.0 inch centers. Similar to the upstanding wall 24, the elongated body 12 may also be provided with only one elongated through slot to accommodate a plurality of threaded fasteners 35.

Figure 9:
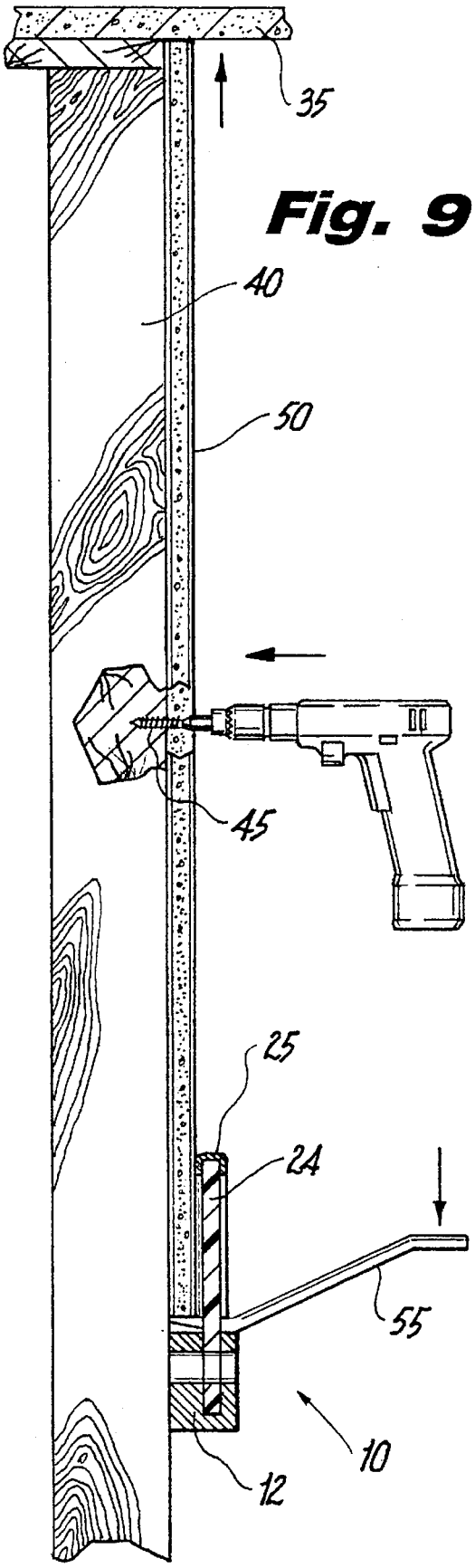
FIG. 9 is a cross-sectional view taken along line 9—9 of FIG. 7.

With continuing reference to FIG. 2, the upstanding wall 24 of building panel handling device 10 is also provided with three equally spaced apart generally rectangular access ports 30*a*–30*c* which are adapted and configured to permit the utilization of a lever or pry bar to facilitate the manipulation of a building panel once it has been properly positioned within the "L-shaped" support region of the handling device 10. For example, as illustrated in FIG. 9, when constructing a wall, it may be necessary to lift a wall board so that it is positioned tightly against the ceiling prior to permanently securing the wall board in place. In a preferred embodiment of the subject invention, the length of each of the access ports 30*a*–30*c* is between 2.0 and 3.0 inches and the height of each access port is between 1.0 and 2.0 inches. Preferably, the center-to-center spacing of access ports 30*a*–30*c* is approximately 32.0 inches.

As best seen in FIG. 4, in one preferred embodiment of the subject invention, the elongated body 12 and the upstanding wall 24 of panel handling device 10 are constructed as half-sections 12*a*, 12*b* and 24*a*, 24*b*, respectively, which are foldably connected to one another along a central hinge 15 so that the device may be conveniently folded along its length to facilitate storage and transport. Those skilled in the art will readily appreciate that the device could be provide with several spaced apart hinges to further reduce the overall storage length of the device.

Referring to FIG. 2 in conjunction with FIG. 5, the building panel handling device 10 also includes a pair of conventional liquid bubble-type leveling instruments 32*a* and 32*b* which are embedded in corresponding portals 34*a* and 34*b* formed within the front surface 14 of elongated body 12. The liquid leveling instruments provide a mechanism for determining the horizontal orientation of the building panel handling device 10 with respect to the supporting structure to which it is temporarily secured, i.e., stud wall 40. Those skilled in the art will recognize that other conventional leveling mechanisms may be employed such as for example, plumb lines, or the like.

In use, once the panel handling device 10 of the subject invention has been properly positioned at a desired height "h" with respect to the stud wall as shown in FIG. 3 (approximately 48.25 inches from ceiling 35 at either corner), horizontally balanced utilizing the liquid leveling instruments 32*a* and 32*b* illustrated in FIG. 5, and temporarily secured to the stud wall utilizing a plurality of threaded fasteners 35 as shown in FIG. 4, a building panel 50 may be easily positioned between the upstanding wall 24 of handling device 10 and the stud wall 40 by one person "A" without any assistance.

Thereafter, also without any assistance, individual "A" can easily adjust the height of building panel 50 within the "L-shaped" support region of handling device 10 by utilizing a conventional tool such as a lever or pry bar 55 extended through either one of the spaced apart access ports 30*a*–30*c* formed in the upstanding wall 24 of the device, as illustrated, for example, in FIG. 9. More particularly, since the building panel handling device 10 is initially positioned 48.25 inches from ceiling 35, it is necessary to lift the building panel 50 approximately 0.25 inches toward the ceiling with the pry bar 55. Once the proper position of the wall board 50 has been attained utilizing the manipulating tool 55, the wall board may 50 be permanently secured to stud wall 40 with a plurality of conventional fasteners 45, as illustrated in FIG. 9. Thereafter, the threaded fasteners 35 temporarily securing the building panel handling device 10 to stud wall 40 may be removed and the handling device 10 may employed at another location.

Although the building panel handling device and method of use therefor of the subject invention has been described with respect to a preferred embodiment, it is apparent that modifications and changes can be made thereto without departing from the spirit and scope of the invention as defined by the appended claims. Furthermore, those having ordinary skill in the art to which the subject invention appertains, will readily appreciate that although the building panel handling device has been described and illustrated herein in conjunction with the hanging of a wall board adjacent a stud wall, it may be used just as easily and in a substantially similar manner to hang a ceiling panel adjacent a plurality of spaced apart ceiling joists or beams.

What is claimed is:

1. A device for handling building panels comprising:

a) an elongated body defining opposed front and rear surfaces and opposed top and bottom surfaces, at least one elongated aperture extending through said body from said front surface to said rear surface to accommodate a plurality of fasteners for temporarily mounting said body to a supporting structure; and b) an upstanding wall projecting from said top surface of said body between said opposed front and rear surfaces thereof, said upstanding wall and said top surface of said body cooperating to form a support region therebetween for temporarily supporting a building panel proximate said supporting structure, a plurality of spaced apart access ports extending through said upstanding wall adjacent said top surface of said body to facilitate manipulation of a building panel positioned in said support region.

2. A device as recited in claim 3, wherein said elongated body is generally rectangular in configuration and said upstanding wall is substantially perpendicular to said top surface of said body.

3. A device as recited in claim 1, wherein said elongated body and said upstanding wall are formed by at least two hingedly connected lengthwise segments.

4. A device as recited in claim 1, wherein said upstanding wall is substantially coextensive with said elongated body.

5. A device as recited in claim 1, wherein the distance between said upstanding wall and said rear surface of said body is greater than the distance between said upstanding wall and said front surface of said body.

6. A device as recited in claim 1, wherein said body includes a plurality of spaced apart elongate apertures extending through said body and the spacing between said apertures corresponds to the spacing between a plurality of spaced apart structural members forming said supporting structure.

7. A device as recited in claim 1, further comprising at least one leveling instrument operatively associated with said body for observing the position of said body relative to said supporting structure.

8. A device as recited in claim 7, wherein at least two leveling instruments are recessed into said front surface of said body and are disposed in spaced apart relationship.

9. A device as recited in claim 1, wherein said upstanding wall is fabricated from a transparent material and a frame extends about a peripheral edge thereof to secure said upstanding wall to said top surface of said body.

10. A device for handling building panels comprising:

a) an elongated body of generally rectangular configuration defining opposed front and rear substantially planar surfaces and opposed top and bottom substantially planar surfaces, a plurality of spaced apart apertures extending through said body from said front surface to said rear surface to accommodate a plurality of fasteners for temporarily mounting said body to a supporting structure; and b) an upstanding wall projecting orthogonally from said top surface of said body, coextensive therewith, and disposed between said opposed front and rear surfaces thereof, said upstanding wall and said top surface of said body cooperating to form a support region therebetween for temporarily supporting a building panel proximate said supporting structure, said upstanding wall having at least one access port extending therethrough to facilitate manipulation of a building panel positioned in said support region.

11. A device as recited in claim 10, wherein said upstanding wall is fabricated from a transparent material and a frame extends about a peripheral edge thereof to secure said upstanding wall to said top surface of said body.

12. A device as recited in claim 10, wherein said plurality of spaced apart apertures extending through said upstanding wall are formed proximate said top surface of said body.

13. A device as recited in claim 10, wherein the distance between said upstanding wall and said rear surface of said body is greater than the distance between said upstanding wall and said front surface of said body.

14. A device as recited in claim 10, wherein the spacing between said plurality of spaced apart apertures extending through said body corresponds to the spacing between a plurality of spaced apart structural members forming said supporting structure.

15. A device as recited in claim 10, further comprising at least one leveling instrument operatively associated with said front surface of said body for observing the position of said body relative to said supporting structure.

16. A method of attaching a building panel adjacent a supporting structure comprising the steps of:

a) positioning an elongated panel handling device having a panel support region defined thereon adjacent a supporting structure;

b) temporarily securing said elongated panel handling device to said supporting structure;

c) positioning an elongated building panel within said panel support region of said panel handling device;

d) manipulating said building panel within said panel support region to adjust the position of said building panel with respect to said supporting structure e) fastening said building panel to said supporting structure;

f) removing said elongated panel handling device from said supporting structure, wherein said step of manipulating said building panel includes the step of extending a manipulating implement through a selected access port defined in said panel handling device.

17. A method according to claim 16, wherein said step of positioning said panel handling device adjacent said supporting structure includes the step of leveling the orientation of said panel handling device relative to said supporting structure.

18. A method according to claim 16, wherein said step of temporarily securing said panel handling device to said supporting structure includes the step of extending a plurality of fasteners through a plurality of spaced apart apertures defined in said device and temporarily securing said plurality of fasteners to said supporting structure.

* * * * *